US005658403A

United States Patent [19]

Kimura

[11] Patent Number: 5,658,403

[45] Date of Patent: Aug. 19, 1997

[54] TITANIUM ALLOY AND METHOD FOR PRODUCTION THEREOF

[75] Inventor: Minami Kimura, Tokyo, Japan

[73] Assignee: Orient Watch Co., Ltd., Tokyo, Japan

[21] Appl. No.: 414,219

[22] Filed: Mar. 31, 1995

Related U.S. Application Data

[62] Division of Ser. No. 352,792, Dec. 1, 1994, Pat. No. 5,509,979.

[30] Foreign Application Priority Data

Dec. 1, 1993 [JP] Japan ..... 5-329941

[51] Int. Cl.[6] ..... C22F 1/18

[52] U.S. Cl. ..... 148/671; 148/669

[58] Field of Search ..... 148/669, 671

[56] References Cited

U.S. PATENT DOCUMENTS

| | | | |
|---|---|---|---|
| 2,819,958 | 1/1958 | Abkowitz et al. | 148/669 |
| 4,067,734 | 1/1978 | Curtis et al. | 148/421 |
| 4,167,427 | 9/1979 | Ueda et al. | 148/669 |
| 4,878,966 | 11/1989 | Alheritiere et al. | 148/421 |
| 5,171,375 | 12/1992 | Wakabayashi et al. | 148/421 |

FOREIGN PATENT DOCUMENTS

| | | | |
|---|---|---|---|
| 5-59510 | 3/1993 | Japan | 148/669 |

*Primary Examiner*—John Sheehan
*Attorney, Agent, or Firm*—Ronald R. Snider

[57] ABSTRACT

A titanium alloy possessing an equiaxial two-phase ($\alpha+\beta$) structure having an average grain size in the range of from 1 μm to 10 μm is obtained by a prescribed heat treatment of a titanium alloy material having a composition represented by the following formula 1, $$Ti_{100-a-b-c-d-e}Al_aV_bFe_cMo_dO_e \quad (1)$$

(wherein a, b, c, d, and e respectively satisfy the relations, $3.0 \leqq a \leqq 5.0$, $2.1 \leqq b \leqq 3.7$, $0.85 \leqq c \leqq 3.15$, $0.85 \leqq d \leqq 3.15$, and $0.06 \leqq e \leqq 0.20$). The titanium alloy is formed in prescribed shape and size and finished with a mirror surface. It is produced by a method which comprises subjecting a titanium alloy material having a composition represented by the formula 1 to a solid solution treatment at a temperature in an $\alpha+\beta$ range 25° C.–100° C. lower than the $\beta$ transformation point, quenching the solid solution, and further subjecting the quenched mass to a treatment of age hardening at a temperature not exceeding the a transformation point.

3 Claims, No Drawings

TITANIUM ALLOY AND METHOD FOR PRODUCTION THEREOF

This is a division of application Ser. No. 08/352,792 filed Dec. 1, 1994, now U.S. Pat. No. 5,509,979.

BACKGROUND OF THE INVENTION

1. Field of the Invention:

This invention relates to a titanium alloy and a method for the production thereof, and more particularly to a titanium alloy with a mirror polished surface and as a raw material for ornaments and a method for the production thereof.

2. Description of the Prior Art;

Titanium alloys are metallic materials which possess numerous advantages including small specific gravity, high strength, and excellent corrosionproofness.

When these titanium alloys are adopted for such ordinary mechanical parts as valves, automobile engine parts, and bicycle parts, they are not required to be finished with a mirror surface comparable with the attractive appearance of ornaments. For such ornaments as watches, however, the titanium alloys are required to be finished With a mirror surface in addition to being vested with the features mentioned above.

Incidentally, the conventional titanium alloys are highly susceptible of oxidation and deficient in thermal conductivity and, therefore, liable to acquire a high temperature while being mirror polished. The polishing, therefore, entails problems such as grinding burn and discoloration of titanium alloys, excessive wear of polishing tools, and clogging of grindstones used for polishing, for example. Since the mirror finish of these titanium alloys is very difficult, it has been necessary to use such measures as stain finish, hairline finish, overcoating as with glass in the place of mirror finish.

In the ordinary a $\alpha+\beta$ type titanium alloy, since the $\alpha$ phase and the $\beta$ phase which are in a complexed state have different hardness and workability and severally have large grain sizes ranging from 30 to 80 μm, the body phase of the alloy is selectively polished. The titanium alloy is at a disadvantage, therefore, in acquiring large irregularities in the polished surface and failing to obtain a mirror surface.

As a technique aimed at overcoming this disadvantage, JP-A-02-258,960 discloses a method for the heat treatment of a titanium alloy. This method of heat treatment comprises transforming an $\alpha+\beta$ type titanium alloy or a $\beta$ type titanium alloy into a $\beta$ solid solution at a temperature exceeding the $\beta$ transformation point, quenching the solid solution to normal room temperature, and further subjecting the quenched mass to a treatment of age hardening at a temperature not exceeding the $\beta$ transformation point thereby effecting precipitation of a fine $\alpha$ precipitate within a martensite phase and a $\beta$ phase throughout the tire surface.

Since this method forms the solid solution at a high temperature, it entails the problem that the solid solution acquires strain from the heat treatment and the product resulting from the heat treatment tends to generate torsion and deformation.

Such parts as watches and other similar ornaments which are small and feature attractive appearance must infallibly preclude such deformations as mentioned above. It has been difficult both technically and economically, however, to provide correction of shape for parts which have sustained deformations during the course of the aforementioned solid solution treatment.

Further, since this method performs the treatment for the formation of the $\beta$ solid solution at a temperature exceeding the $\beta$ transformation point, the $\beta$ grains in the residual $\beta$ phase tend to grow in grain size and, as a result, the individual $\beta$ grains manifest difference in property for undergoing polishing due to the difference in crystal orientation of the grains. Thus, the ornamental .parts provided by the method of heat treatment under consideration equal in quality of mirror finish to the parts made of austenite type stainless steel. By visual observation, the mirror finishes obtained in such ornamental parts are found to fall short of those obtained in the parts of such hard alloys as stellite.

SUMMARY OF THE INVENTION

It is, therefore, an object of this invention to solve the problems of the prior art mentioned above and provide a titanium alloy particularly useful for ornaments and a method for the production thereof.

The titanium alloy of the first aspect of this invention is obtained by heat-treating a titanium alloy material having a composition represented by the following formula 1 and is characterized by possessing an equiaxial two-phase ($\alpha+\beta$) structure having an average grain size in the range of from 1 μm to 10 μm.

$$Ti_{100-a-b-c-d-e}Al_aV_bFe_cMo_dO_e \quad (1)$$

(wherein a, b, c, d, and e respectively satisfy the relations, $3.0 \leqq a \leqq 5.0$, $2.1b \leqq 3.7$, $0.85 \leqq c \leqq 3.15$, $0.85 \leqq d \leqq 3.15$, and $0.06 \leqq e \leqq 0.20$).

The titanium alloy of the second aspect of this invention is characterized in that the titanium alloy set forth in the first aspect of this invention is formed in prescribed shape and size and finished in a mirror surface.

The method for the production of a titanium alloy of the third aspect of this invention is characterized by subjecting a titanium alloy material having a composition represented by the formula 1 to a solid solution treatment at a temperature in an $\alpha+\beta$ range 25° C.–100° C. lower than the $\beta$ transformation point, quenching the solid solution, and further subjecting the quenched mass to a treatment of age hardening at a temperature not exceeding the a transformation point.

The method for the production of a titanium alloy of the fourth aspect of this invention is characterized in that the treatment of age hardning in the method of the third aspect of this invention is carried out at a temperature in the range of from 300° C. to 600° C.

The method for the production of a titanium alloy of the fifth aspect of this invention is characterized in that, in the method set forth in the third or fourth aspect of this invention, the titanium alloy material is suitably machined and formed in the prescribed shape and size, then subjected to the treatment the solid solution treatment and the treatment of age hardening, and further subjected to a treatment for impartation of a mirror finish.

The method for the production of a titanium alloy of the sixth aspect of this invention is characterized in that, in the method set forth in the third or fourth aspect of this invention, the titanium alloy material is subjected to solid solution treatment and the treatment of age hardening, then suitably machined and formed in the prescribed shape and size, and further subjected to a treatment for impartation of a mirror finish. The method for the production of a titanium alloy of the seventh aspect of this invenntion is characterized in that, in the method set forth in the third or fourth aspect of this invention, the titanium alloy material is suitably machined and formed in approximate shape and size, subjected to the solid solution treatment and the treatment of age hardening, again suitably machined and formed in the prescribed shape and size, and further subjected to a treatment for impartation of a mirror finish.

DETAILED DESCRIPTION OF PREFERRED EMBODIMENTS

Now, the constitution of this invention will be described more specifically below.

In the titanium alloy and the method for production thereof according this invention, the titanium alloy material as the raw material (prior to heat treatment) has a composition represented by the formula 1 mentioned above and possesses a superplasticity. The reason for fixing the composition of the titanium alloy material as described above is as follows.

The Al component is an element for forming the α phase. If the content of this Al component is less than 3%, the titanium alloy material will be deficient in strength. If this content exceeds 5%, the amounts of V, Mo, and Fe to be added as β phase stabilizing elements for lowering the β transformation point will have to be increased and the superplasticity of the titanium alloy material will be lowered as well. The content of the Al component, therefore, is set at the range of from 3% to 5%.

If the content of the V component is less than 2.1%, the α+β type titanium alloy structure which manifests a superplasticity in the titanium alloy material will not be easily obtained. If this content exceeds 3.7%, the V component will form a solid solution in the a phase and the range of temperature of a solid solution treatment the α+β structure which is capable of undergoing mirror polishing will be narrowed.

The Mo component is an element for stabilizing the β phase and lowering the β transformation point. This Mo component exhibits a low speed of diffusion. If the content of this MO component is less than 0.85%, the β grains will be coarsened during the solid solution treatment and the produced titanium alloy (after heat treatment) will suffer a loss in elongation. If this content exceeds 3.15%, the specific gravity of the titanium alloy material will increase.

The Fe component is an element for stabilizing the β phase and serves the purpose of lowering the β transformation point and stabilizing the α+β range. If the content of the Fe component is less than 0.85%, the Fe component will not lend itself to the stabilization of the β grains during solid solution treatment. Conversely, if the content exceeds 3.15%, the coefficient of diffusion will be enlarged and, as a result, the coarsening of the β grains will proceed and the produced titanium alloy will suffer a loss of elongation. The O component is an element for enhancing strength. If the content of this O component is less than 0.06%, the effect of enhancing the strength of the titanium alloy material will not be observed. If this content exceeds 0.2%, the titanium alloy material will obtain an increase in strength but suffer a decrease in elongation.

With the titanium alloy material possessing the composition described above and used as a raw material, it is extremely difficult to obtain on a commercial scale a titanium alloy which possesses a fine α+β structure having an average grain size (the definition of which term will be described hereinbelow) of less than 1 μm. If the produced titanium alloy forms an α+β structure having an average grain size exceeding 10 μm, it will not acquire an ideal superplasticity. Thus, the average grain size of the equiaxial two-phase (α+β) structure is required to be not less than 1 μm and not more than 10 μm.

The average grain size of an α+β titanium alloy mentioned above is determined by treating a given sample with an etching liquid (mixed solution of nitric acid and hydrofluoric acid), photographing the etched sample as enlarged to not less than 800 magnifications with an optical microscope, drawing two perpendicularly intersecting line segments not less than 30 μm in length at several points on the magnified photograph, counting the number of grains crossed by each of the intersecting line segments, and averaging the numbers consequently obtained. This average is reported as the average grain size. For the determination of the average grain size, the photograph is obtained effectively by the use of a scanning electron microscope.

In this invention, the optimum temperature of the solid solution treatment and the optimum temperature of the treatment of age hardening are both variable with the composition of the titanium alloy because the β transformation point is variable with the composition of the titanium alloy. The temperature of the solid solution treatment is desired to be in the α+β range which is 25%–100° C. lower than the β transformation point (properly the range is from 800° C. to 875° C., preferably from 825° C. to 850° C., when the transformation point is 900° C.) and the temperature of the treatment of age hardening is desired to be in the range of from 300° C. to 600° C. When the composition of the titanium alloy is in the range defined by this invention, the heat treatment can be stably and efficiently carried out in the α+β phase on a commercial scale by confining the temperature of the solid solution treatment within the aforementioned α+β range. If the temperature of this solid solution treatment is lower than "β transformation point–100° C.," the time of this solid solution treatment will have to be elongated and the conditions generally accepted as beneficial for a commercial treatment will be difficult. If this temperature is higher than "β transformation point less 25° C.," the temperature distribution within the oven being used for the heat treatment will have to be extremely uniform. When a multiplicity of pieces of titanium alloy having a composition within the aforementioned range are treated where the β transformation point is less than 900° C., they will entail local rise of temperature or uneven distribution of temperature and tend to induce selective treatment of the β phase unless the temperature distribution in the oven is extremely uniform.

Further, by confining the temperature of the treatment of age hardning within the range of from 300° C. to 600° C., the fine a phase capable of undergoing mirror polishing can be precipitated quickly and uniformly, i.e. under conditions advantageous from the commercial point of view. If the temperature for the treatment of age hardning is lower than 300° C., the time required for precipitating the a phase enough to acquire necessary hardness will be elongated possibly to the extent of boosting the cost of production. If this temperature is higher than 600° C., the crystal grains of the a phase will be coarsened possibly to the extent of rendering mirror polishing difficult.

The solid solution treatment and the treatment of age hardning desired to be carried out in an atmosphere of such an inert gas as argon or under a vacuum for the purpose of preventing the titanium alloy material from oxidation.

The a solid solution treatment and the treatment of age hardening are normally required to be carried out for a duration in the approximate range of from 0.5 to 5 hours. The process of quenching which follows the a solid solution treatment can be performed by the use of such a non-oxidative gas as $N_2$ gas or an oil coolant. While the titanium alloy material is generally cooled to normal room temperature, it suffices herein to continue the cooling until 300° C.

The mirror finish mentioned above can be attained by any of the well-known methods such as, for example, the method using a water-soluble abradant (alumina type abradant) or the method using a buff.

For the purpose of producing the titanium alloy finished by a mirror polishing and used for such ornaments as watch parts (such as, for example, watch cases, back plates and bands), it suffices to adopt the method which is set forth in any of fifth, sixth, and seventh aspects of this invention.

In this case, the step for machining an ornament, namely the step for forming it in prescribed shape and size, is carried out in either the former stage or the latter stage of the step for heat treatment which comprises the solid solution treatment and the treatment of age hardning or in both the former stage and the latter stage thereof. This step of machining can be performed by any of the well-known machining (forging, rolling, drawing, extrusion, disconnection, cutting, end grinding) or by any of the well-known methods of fabrication such as electric discharge machining and laser beam machining.

Since the titanium alloy material as a raw material which is set forth in the first aspect of this invention and the titanium alloy obtained as a finished product by the method set forth in the third aspect of this invention both have an excellent superplasticity, they can be easily machined to form ornaments with prescribed shapes and sizes. The α+β type titanium alloy set forth in the first aspect of this invention is so fine as to have an average grain size of several μm and, therefore, manifests a superplasticity. The titanium alloy of which a chemical composition is represented by the formula 1, and assumes an β+β two-phase structure which is inherently liable to manifest a superplasticity, exhibits an ability to acquire an equiaxial structure by cross rolling and a generous reduction in grain size by thermomechanical treatment. In consequence of the heat treatment, the crystal grain size of the α phase and the β phase range from 1 to 10 μm. Therefore, this titanium alloy acquires an ability to undergo a mirror finish (discernible with an unaided eye) notwithstanding these two phases differ in polishing property.

The titanium alloy-material set forth in first aspect of this invention is enabled to acquire strength equal to or greater than the ordinary titanium alloy when it is subjected to the solid solution treatment at a temperature exceeding the β transformation point and then subjected to the treatment of age hardening at a temperature in the range of from 300° C. to 600° C. In the titanium alloy which has undergone these two treatments, the old β grains still persisting therein have been coarsened. In spite of the newly precipitated α" phase and the pro-eutectoid α a grains which are finely distributed therein, this titanium alloy acquires a mirror surface with difficulty because the coarse old β grains manifest their adverse effect during the course of polishing.

In this invention, this titanium alloy material is enabled to acquire an α" martensite phase when it is subjected to the solid solution treatmennt as held in the α+β range which is 25° C.–100° C. lower than the β transformation point and then subjected to quenching. Further, the titanium alloy is enabled to acquire a fine two-phase (α+β) structure having crystal grain sizes of about several μm in the α phase and the phase when it is subjected to the treatment of age hardening at a temperature lower than the a transformation point.

Since these grains are extremely minute, the titanium alloy is easily given a mirror surface by polishing because the difference in depth of polishing due to the possible difference in hardness between the phases is no longer conspicuous.

When the α+β type titanium alloy material is heated in the neighborhood of the β transformation point, the β crystal grains are coarsened. Thus, in spite of the precipitation of a fine a phase, this titanium alloy is prevented from acquiring a mirror surface owing to the influence of the old β grains.

When the titanium alloy material is heated in the α+β two-phase range 25° C.–100° C. lower than the β transformation point, quenched, and then subjected to the treatment of age hardening at a temperature in the range of from 300° C. to 600° C. in accordance with the present invention, it is enabled to acquire an equiaxial α+β type structure having an average grain size of not less than 1 μm and not more than 10 μm. The titanium alloy which possesses this structuure is capable of undergoing mirror polishing.

The α+β type titanium alloy material set forth in the first aspect of this invention exhibits a property of superplasticity at a temperature in the range of from 700° C. to 900° C. and, therefore, is capable of producing watch ornaments by superplastic forming. In accordance With the method set forth in any of the third to fifth aspects of this invention, therefore, titanium alloy parts finished by the mirror polishing which are complicated in shape such as watch ornaments can be easily manufactured.

The α+β type titanium alloy material has a β rich structure in an annealed state and manifests ideal workability of the β phase and, therefore, can be formed by cold drawing, cold forging, etc. As a result, this titanium alloy material can be finished by cold forging after the superplastic forming or can be formed in prescribed shape and size exclusively by cold working without being preceded by the superplastic forming. It can be given a mirror polishing after it has been formed in prescribed shape and size only by cutting without use of a metallic die, subjected to the solid solution treatment, and then subjected to the treatment of age hardening and consequently vested with a fine α+β structure.

Now this invention will be described more specifically below with reference to working examples.

EXAMPLE 1

A titanium alloy material (β transformation point 900° C.) having a composition shown in Table 1 below, possessing an α+β type structure of an average grain size of 2 μm, and measuring 6 mm in thickness was used.

TABLE 1

| Component | Ti | Al | V | Fe | Mo | O |
|---|---|---|---|---|---|---|
| wt % | Balance | 4.5 | 3 | 2 | 2 | 0.1 |

This alloy material was formed neatly by the wire-cut electron discharge machining to prepare a blank. This blank was subjected to a solid solution treatment under a vacuum at 850° C. (50° C. lower than the β transformation point) for one hour and then quenched with $N_2$, gas. Further, the blank was subjected to a treatment of age hardening under a vacuum at 500° C. for one hour and consequently vested with a fine equiaxial two-phase α+β type structure exhibiting a Vickers hardness of HV 400 and an average grain size of 1.5 μm.

This blank was found to have formed a skin of TiN 0.1 μm in thickness on the surface thereof. It was subjected to polishing with a commercially available alumina type water-soluble abradant (produced by Marumoto Kogyo K.K. and marketed under product code of "OP-S") to be stripped of the TiN skin. Consequently, a watch case of mirror finish was obtained.

EXAMPLE 2

A titanium alloy material identical with the material used in Example 1. while having a different thickness of 8 mm was formed in prescribed shape and size by the wire cutter electron discharge machining to prepare a blank. This blank was subjected to superplastic forming with a metallic die heated in advance to 800° C. at a pressure rate of 1 mm per minute and, after the load had reached six tons, held at this load for 20 minutes, to obtain a watch case blank in prescribed shape and size.

This watch case blank was machined, then subjected to a solid solution treatment at the α+β two-phase range of 825° C., namely a temperature 75° C. lower than the β transformation point of the alloy, in an atmosphere of argon (Ar) for two hours, cooled in oil, and subjected to a treatment of age hardening under a vacuum at 500° C. for three hours to be vested with a fine α+β equiaxial two-phase structure having a HV 440±20 and an average grain size of 3 μm. This blank was subjected to polishing with the same abradant as used in Example 1 to obtain a watch case having a mirror finish.

EXAMPLE 3

A titanium alloy material identical with the material of Example 1 while having a different thickness 5 mm was cold drawn and then cold bent to prepare a blank. It was then subjected to a solid solution treatment in an atmosphere of argon at 825° C. for two hours, cooled in oil, and then subjected to a treatment of age hardening under a vacuum at 500° C. for three hours to be vested with a fine equiaxial α+β two-phase structure having a HV of 440±10 and an average grain size of 1.8 μm to 3 μm. This blank was ground with a grindstone and then subjected to polishing with the same abradant as used in Example 1 to obtain a watch case having a mirror finish.

EXAMPLE 4

A titanium alloy material identical with the material of Example 1 while having a different thickness of 3 mm was cold drawn and forged, formed in prescribed final shape and size, and subjected to a boring work to prepare a band segment blank.

This blank was subjected to a solid solution treatment under a vacuum at 800° C. for one hour, quenched with $N_2$ gas, and then subjected to a treatment of age hardening under a vacuum at 500° C. for one hour to be vested with a fine equiaxial α+β two-phase structure having a HV 440±10 and an average grain size of 1.8 μm to 3 μm. This blank was buffed with an abradant of chromium oxide and consequently given a mirror finish.

EXAMPLE 5

A titanium alloy material identical with the material of Example 1 while having a different thickness of 5.3 mm was cold drawn to prepare a blank. This blank was subjected to a solid solution treatment in an atmosphere of argon at 825° C. for two hours and then cooled in oil. The blank was subjected to a treatment of age hardeninig under avacuum at 500° C. for three hours to be vested with a fine equiaxial α+β two-phase structure having a HV 440±10 and an average grain size of 2 μm. This blank was cut and ground mechanically, formed in prescribed final shape and size, and subjected to polishing with the same abradant as used in Example 1. Thus, it was given a mirror finish.

EXAMPLE 6

A titanium alloy material identical with the material of Example 1 while having a thickness of 6 mm was cut, subjected to a solid solution treatment under avacuum at 850° C. for one hour, quenched with $N_2$ gas, and subjected to a treatment of age hardening under a vacuum at 500° C. for one hour to be vested with a fine equiaxial α+β two-phase structure having a HV 420±10 and an average gain size of 2μm. The platelike alloy material was cut and ground to obtain a watch case of prescribed shape and size and then subjected to polishing with the same abradant as used in Example 1 to be given a mirror finish.

COMPARATIVE EXAMPLE 1

An α+β type titanium alloy material having a thickness of 6 mm and an average grain size of 2 μm similarly to the material of Example 1 was formed neatly in shape and size by the wire cut electron discharge machining to prepare a blank.

This blank was subjected to a solid solution treatment under a vacuum at 925° C., a temperature exceeding the β transformation point, for one hour and then quenched. It was then heated under a vacuum at 500° C. for one hour and left cooling until a HV 500.

As a result, the blank acquired a structure having a fine needle a phase precipitated within coarse old β grains having an average crystal grain size of 300 μm. When this treated blank was subjected to polishing with the same abradant as used in Example 1, it failed to acquire a mirror surface.

The conditions for the heat treatments (solid solution treatment and treatment of age hardening) involved in the working examples and the comparative examplecited above and the qualities of the created titanium alloy materials concerning the ability to undergo polishing for mirror finish and the surface roughness after the polishing are shown in Table 2. The hardness was tested on the HV hardness scale and the surface roughness on the $R_{max}$.

TABLE 2

| | Solid solution treatment | Treatment of age hardening | Hardness | Condition of surface after polishing | $R_{max}$ |
|---|---|---|---|---|---|
| Example 1 | 850° C. × 1 hour (50° C. lower than β transformation point) | 500° C. × 1 hour | 400 | Perfectly mirror surface | 0.2 μm |

TABLE 2-continued

| | Solid solution treatment | Treatment of age hardening | Hardness | Condition of surface after polishing | $R_{max}$ |
|---|---|---|---|---|---|
| Example 2 | 325° C. × 2 hours (75° C. lower than β transformation point) | 500° C. × 3 hours | 440 | Perfectly mirror surface | 0.2 μm |
| Example 3 | 825° C. × 2 hours (75° C. lower than β transformation point) | 500° C. × 3 hours | 440 | Perfectly mirror surface | 0.2 μm |
| Example 5 | 825° C. × 2 hours (75° C. lower than β transformation point) | 500° C. × 3 hours | 440 | Perfectly mirror surface | 0.2 μm |
| Example 6 | 850° C. × 1 hour (50° C. lower than β transformation point) | 500° C. × 1 hour | 420 | Perfectly mirror surface | 0.2 μm |
| Comparative Example 1 | 925° C. × 1 hour (25° C. lower than β transformation point) | 500° C. × 1 hour | 500 | Not enough | 0.3 μm |

As is clearly noted from the description given thus far, the titanium alloy set forth in the first aspect of this invention is a titanium alloy obtained by heat-treating a titanium alloy material having a composition represented by the formula 1 mentioned above, and the alloy possesses an equiaxial two-phase (α+β) structure having an average grain size in the range of from 1 μm to 10 μm. As a result, the titanium alloy manifests an ability to undergo polishing easily and acquire a mirror surface. Further, this titanium alloy material possesses a superplasticity at a temperature in the range of from 700° C. to 900° C. and the titanium alloy of the first aspect of this invention which is obtained from this titanium alloy material likewise possesses a superplasticity. By having this titanium alloy material suitably subjected to superplastic forming and then polished for mirror finish, therefore, titanium alloy parts possessing heretofore unattainable excellent appearance can be produced. Particularly, high-grade ornaments having complicated shapes such as, for example, watch ornaments can be easily obtained.

The titanium alloy set forth in the second aspect of this invention is a metallic material which is suitable for such ornaments as watch parts.

The method for production of a titanium alloy set forth in the third aspect of this invention consists in perfonning prescribed heat treatment on a titanium alloy material having a composition represented by the formula 1 mentioned above. By this method of production, a titanium alloy possessing a crystal structure set forth in the first aspect of this invention can be obtained.

The method for production of a titanium alloy set forth in the fourth aspect of this invention permits production of a titanium alloy possessing strength equal to higher than the ordinary titanium alloy by a treatment of age hardening at a temperature in the range of from 300° C. to 600° C.

The method for production of a titanium alloy set forth in any of fifth, sixth, and seventh aspects of this invention permits production of ornaments in desired shape and size because this method comprises suitable working, such as machining and polishing for mirror finish. Particularly, high-grade ornaments having complicated shapes such as, for example, watch ornaments can be easily obtained by this method without a sacrifice of the corrosionproofness and the hardness inherently owned by titanium and titanium alloys.

What is claimed is:

1. A method for the production of a titanium alloy comprising the steps of:

beginning with a titanium alloy having a composition in accordance with the following formula $$Ti_{100-a-b-c-d-e}Al_aV_bFe_cMo_dO_e$$

(wherein a, b, c, d, and e are weight percent and respectively satisfy the relations, $3.0 \leqq a \leqq 5.0$, $2.1 \leqq b \leqq 3.7$, $0.85 \leqq c \leqq 3.15$, $0.85 \leqq d \leqq 3.15$, and $0.06 \leqq e \leqq 0.20$);

subjecting said titanium alloy to a solid solution treatment at a temperature of 45° to 100° C. lower than the β transformation point;

quenching the solid solution;

further subjecting the quenched mass to a treatment of age hardening at a temperature in the range of from 300° C. to 600° C.; and which is characterized in that said titanium alloy material is suitably machined and formed in prescribed shape and size, then subjected to said solid solution treatment and said treatment of age hardening, and further subjected to a treatment for impartation of a mirror finish.

2. A method for the production of a titanium alloy comprising the steps of:

beginning with a titanium alloy having a composition in accordance with the following formula $$Ti_{100-a-b-c-d-e}Al_aV_bFe_cMo_dO_e$$

(wherein a, b, c, d, and e are weight percent and respectively satisfy the relations, $3.0 \leqq n \leqq 5.0$, $2.1 \leqq b \leqq 3.7$, $0.85 \leqq c \leqq 3.15$, $0.85 \leqq d \leqq 3.15$, and $0.06 \leqq e \leqq 0.20$);

subjecting said titanium alloy to a solid solution treatment at a temperature of 45° C. to 100° C. lower than the β transformation point;

quenching the solid solution;

further subjecting the quenched mass to a treatment of age hardening at a temperature in the range of from 300° C., to 600° C.; and which is characterized in that said titanium alloy material is subjected to said solid solution treatment and said treatment of age hardening, then suitably machined and formed in prescribed shape and sized, and further subjected to a treatment for impartation of a mirror finish.

3. A method for the production titanium-alloy comprising the steps of:

beginning with a titanium alloy having a composition in accordance with the following formula $$Ti_{100-a-b-c-d-e}Al_aV_bFe_cMo_dO_e$$

(wherein a, b, c, d, and e are weight percent and respectively satisfy the relations, $3.0 \leqq a \leqq 5.0$, $2.1 \leqq b \leqq 3.7$, $0.85 \leqq c \leqq 3.15$, $0.85 \leqq d \leqq 3.15$, and $0.06 \leqq e \leqq 0.20$);

subjecting said titanium alloy to a solid solution treatment at a temperature 45° to 100° C. lower then the β transformation point;

quenching the solid solution;

further subjecting the quenched mass to a treatment of age hardening at a temperature in the range of from 300° C. to 600° C.; and which is characterized in that said titanium alloy material is suitably machined and formed in approximate shape and size, subjected to said solid solution treatment and a treatment of age hardening, again suitably machined and formed in prescribed shape and size, and further subjected to a treatment for impartation of a mirror finish.

* * * * *